United States Patent [19]

Jacobozzi et al.

[11] Patent Number: 4,531,638

[45] Date of Patent: Jul. 30, 1985

[54] MOUNTING MEANS FOR REMEMBRANCE ITEMS

[75] Inventors: Vivian M. Jacobozzi, 2836 N. 76th Pl., Scottsdale, Ariz. 85251; Steven D. Beltrand, Scottsdale, Ariz.

[73] Assignee: Vivian M. Jacobozzi, Scottsdale, Ariz.

[21] Appl. No.: 553,362

[22] Filed: Nov. 18, 1983

[51] Int. Cl.[3] ..... B65D 77/00

[52] U.S. Cl. ..... 206/486; 206/388; 206/457; 248/450

[58] Field of Search ..... 206/457, 388, 486, 487, 206/45.28, 45.33; 248/450; 46/38; 40/124, 124.4; 229/8

[56] References Cited

U.S. PATENT DOCUMENTS

| | | | |
|---|---|---|---|
| 732,828 | 7/1903 | Christopher | 248/450 |
| 1,079,097 | 11/1913 | Beatty | 248/450 |
| 1,579,720 | 4/1926 | Lerner | 248/450 |
| 1,589,145 | 6/1926 | Gollnik | 229/8 |
| 1,671,273 | 5/1928 | Carley | 229/8 |
| 1,673,144 | 6/1928 | George | 229/8 |
| 1,734,032 | 11/1929 | Evans | 206/486 |
| 1,792,572 | 2/1931 | Buswell | 229/8 |
| 1,996,172 | 4/1935 | Reed | 206/45.14 |
| 2,153,976 | 4/1939 | Thorman | 206/278 |
| 2,169,382 | 8/1939 | Domenico et al. | 229/8 |
| 2,547,676 | 4/1951 | Updike | 229/8 |
| 2,612,989 | 10/1952 | Harrison | 206/45.33 |
| 2,628,169 | 2/1953 | Berthold, Jr. | 229/8 |
| 2,649,957 | 8/1953 | Gapstur | 206/45.14 |
| 3,099,568 | 7/1963 | Brody et al. | 206/45.33 |
| 3,134,484 | 5/1964 | Cox et al. | 206/45.34 |
| 3,332,787 | 7/1967 | Wagenheim | 229/8 |
| 3,753,519 | 8/1973 | Gammon | 206/486 |
| 4,294,350 | 10/1981 | Haase et al. | 383/71 |
| 4,310,095 | 1/1982 | Fontlladosa | 248/450 |

FOREIGN PATENT DOCUMENTS

| | | | |
|---|---|---|---|
| 284972 | 8/1952 | Switzerland | 229/8 |

*Primary Examiner*—William T. Dixson, Jr.
*Assistant Examiner*—Brenda J. Ehrhardt
*Attorney, Agent, or Firm*—Weiss & Holloway

[57] ABSTRACT

This is an improved mounting means which can be used on special occasions for holding and displaying items that may be given away to guests as a remembrance of the special occasion. The mounting means may be a flat board with circular holes and vertical slots drilled and cut through the board. A circular hole is located at the top of each vertical slot. Thin disks may be attached to the remembrance items in order to facilitate mounting of the items. The remembrance items are mounted by inserting each item into one of the circular holes in the board and then sliding it down the vertical slot below the hole.

17 Claims, 6 Drawing Figures

FIG-1
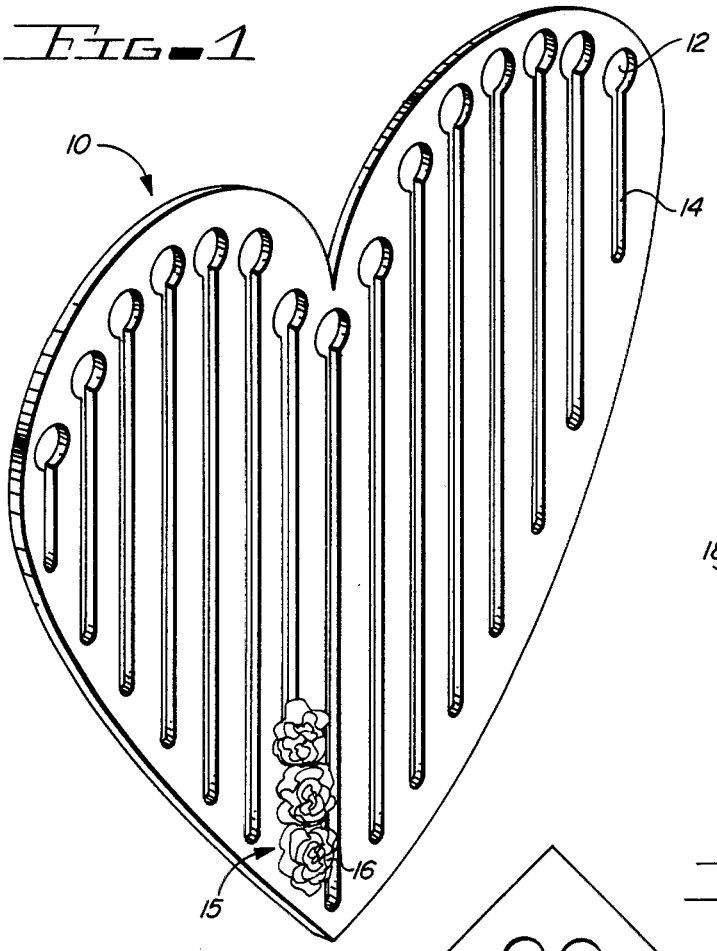
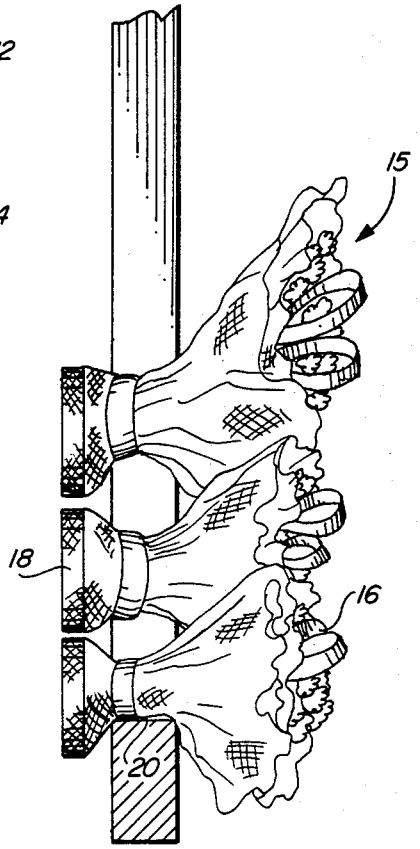
FIG-2
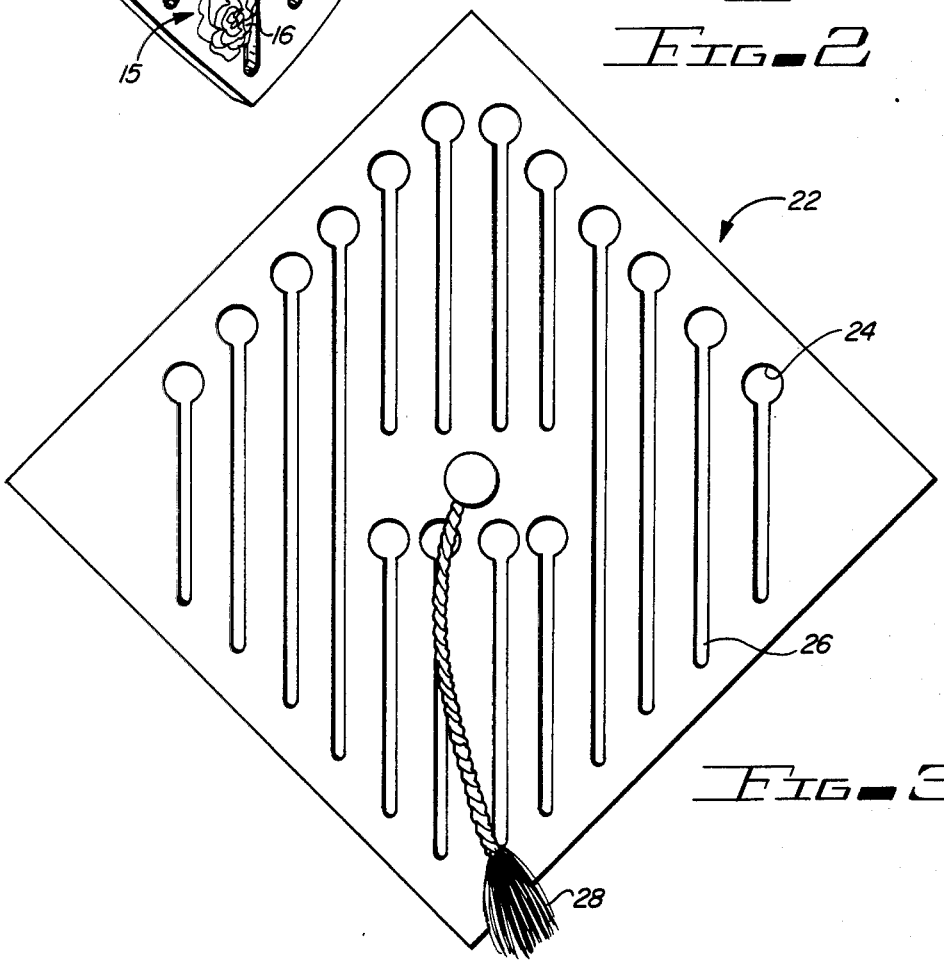
FIG-3

MOUNTING MEANS FOR REMEMBRANCE ITEMS

BACKGROUND OF THE INVENTION

1. Field of the Invention

This invention relates generally to mounting means for holding and displaying items, and more specifically to means for mounting remembrance items on special occasions.

2. Description of the Prior Art

In the past, a variety of different mounting means have been used for the purpose of holding or displaying goods, wares and other merchandise. However, there are a number of special occasions on which mounting means can be used for the purpose of holding and displaying items. For example, on special occasions such as birthdays, weddings or graduations a mounting board may be used for holding and displaying items that can be given away to the guests as a remembrance of the special occasion.

Such a mounting board should have means coupled to the board for the purpose of mounting the remembrance items. In addition, the shape of the board can be varied in order to suit the needs of each special occasion.

Accordingly, a need exists for mounting means which can be used on special occasions for holding and displaying items that can be given away to the guests as a remembrance of the special occasion.

SUMMARY OF THE INVENTION

It is an object of this invention to provide an improved mounting means for remembrance items.

It is another object of this invention to provide improved mounting means for remembrance items having means coupled to the mounting means for the purpose of holding and displaying items that can be given away to guests as a remembrance of a special occasion.

It is a further object of this invention to provide improved mounting means of variable outside configuration for the purpose of holding and displaying remembrance items.

It is still another object of this invention to provide a combination of improved mounting means and mountable remembrance items comprising a mounting support with coupling means and at least one mountable remembrance item removably mounted to the mounting support.

In accordance with one embodiment of this invention, mounting means for mountable remembrance items is disclosed which comprises a mounting support having means coupled to the mounting support for holding a plurality of mountable remembrance items. In this embodiment, circular holes and vertical slots are drilled and cut through the mounting support which is preferably flat in order to facilitate mounting of the remembrance items. The outside configuration of the mounting support may be varied to meet the needs of each special occasion.

In accordance with another embodiment of this invention, a combination of mounting means and mountable remembrance items is disclosed which comprises a mounting support having means coupled to the mounting support for holding a remembrance item, and at least one mountable remembrance item removably mounted to the mounting support. In this embodiment, a thin disk is preferably attached to part of the mountable remembrance item in order to simplify mounting of the remembrance item onto the mounting support. The mountable remembrance item may have a variety of different aesthetic or artistic configurations to suit the needs of each special occasion.

The foregoing and other objects, features, and advantages of the invention will be apparent from the following, more particular description of the preferred embodiments of the invention as illustrated in the accompanying drawings.

BRIEF DESCRIPTION OF THE DRAWING

FIG. 1 is a perspective view of a heart-shaped mounting support with three typical remembrance items mounted thereon.

FIG. 2 is an enlarged cross-sectional view of a portion of the heart-shaped mounting support of FIG. 1 with the three typical remembrance items of FIG. 1 mounted showing how disks at the bottom portion of the remembrance items are used as a coupling means between the support and remembrance items.

FIG. 3 is an elevational view of a square-shaped mounting support with a decorative tassel attached to the support.

DETAILED DESCRIPTION OF THE INVENTION

Figure 4:
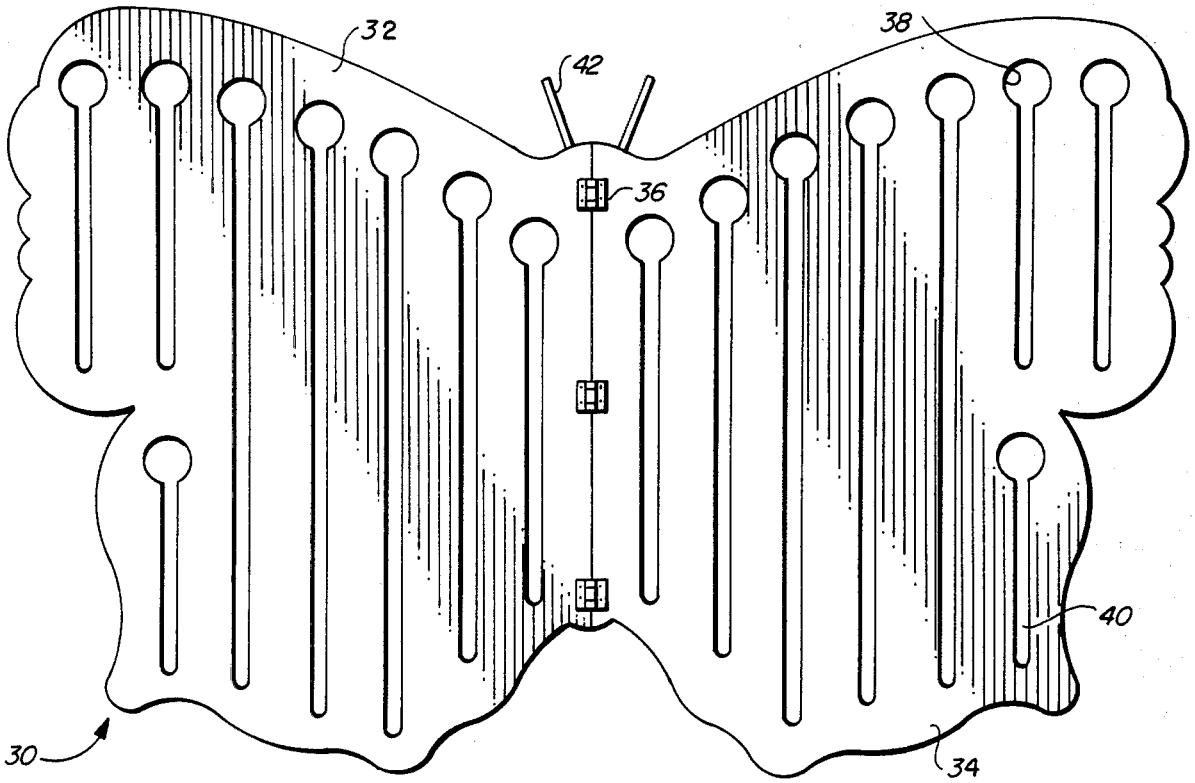
FIG. 4 is an elevational view of a butterfly-shaped mounting support with a plurality of hinges.

Referring to FIGS. 1 and 2, typical mountable remembrance items, generally designated by reference number 15, are shown mounted on a heart-shaped mounting support whose reference number is 10. As illustrated in FIG. 1, circular holes 12 and vertical slots 14 are drilled and cut through the heart-shaped mounting support 10 which is preferably flat and can be made of a material such as wood, plastic, or the like.

FIG. 2 shows a cross sectional view of a portion of the heart-shaped mounting support 10 with three mountable remembrance items 15 already mounted in the vertical slot 14. A remembrance configuration member 16 called a Fluff is shown in enlarged form in FIG. 2. The Fluff 16 that is shown in FIG. 2 consists of a flexible net type fabric with preferably a ribbon tied near its base to present a flower-shaped appearance. The bottom portion of the Fluff 16 below the ribbon is preferably filled with a treat such as candy or the like. This Fluff 16 has the type of artistic configuration which may be given to guests on special occasions as a remembrance of the special occasion. However, various different configurations can be used in order to meet the needs of each special occasion.

Thin disks 18 are shown in FIG. 2 preferably attached to the bottom portion of each of the remembrance configuration members or Fluffs 16. The thin disks 18 are used as a coupling means for attaching the remembrance configuration members or Fluffs 16 to the mounting support 10. The disks 18 are used to simplify and to permit mounting of the remembrance items 15. The disks can be inserted through the circular holes 12 in the mounting support 10 with ease because the diameter of each disk is smaller than that of the hole. The thin disks 18 are attached to the bottom portion of the remembrance configuration members 16 before mounting. In the case of the configuration members 16 shown in FIG. 2, the disks are preferably placed inside the bottom portion of the remembrance configuration members 16 below the ribbon. Preferably candy or the like is placed inside the bottom portion of the configuration members 16 below the ribbon and on top of the disks 18. The remembrance items 15 are mounted by inserting the base of each item 15 through the circular holes 12 using the thin disk 18 as a guide, and then sliding the item 15 down the vertical slot 14 until it comes to rest at the bottom 20 of the slot 14. Note that each item 15 is anchored in its slot 14 because the diameter of the disk 18 is larger than the width of the slot 14. Additional items 15 are inserted in the same manner and slid down the vertical slot 14 until they come to rest on the previously mounted items.

FIG. 3 shows an elevational view of a square-shaped mounting support 22 which is preferably flat. Circular holes 24 and vertical slots 26 are drilled and cut through the square-shaped mounting support 22 as shown in FIG. 3. The holes 24 and the slots 26 function like the holes 12 and the slots 14 of FIG. 1. A decorative tassel 28 is preferably attached to the support. This configuration can also be used for mounting the remembrance items 15.

FIG. 4 illustrates yet another version of a mounting support that can be used for mounting different remembrance items 15. A stylized butterfly-shaped mounting support 30 is shown with hinges 36. The stylized butterfly-shaped mounting support 30 is divided in half as shown in FIG. 4 and held together by preferably three hinges 36. Side 32 represents the left side portion of the stylized butterfly-shaped mounting support 30 and side 34 represents the right side portion. Two small parts 42 are preferably attached for decorative purposes. Circular holes 38 and vertical slots 40 (like the holes 12 and the slots 14 of FIG. 1) are drilled and cut through the mounting support 30 as shown in FIG. 4.

Figure 5:
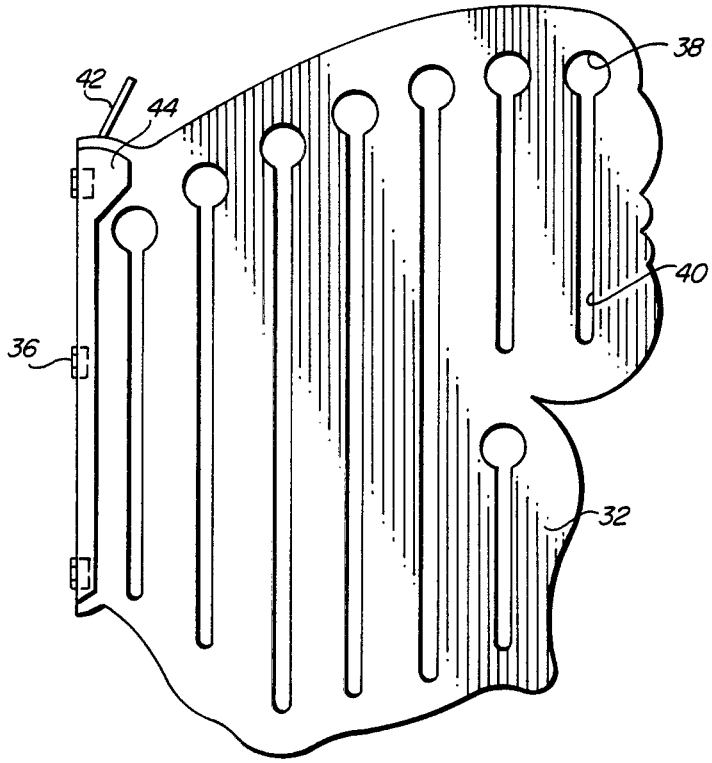
FIG. 5 is an elevational view of the left side portion of the butterfly-shaped mounting support of FIG. 4 (the right side portion is swung behind the visible left side portion).

FIG. 5 is an elevational view of the left side portion 32 of the stylized butterfly-shaped mounting support 30 with the right side portion 34 swung behind the visible left side portion 32. A vertical support 44 is shown in the sketch.

Figure 6:
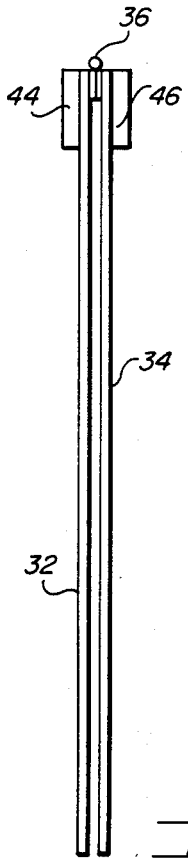
FIG. 6 is a top view of the butterfly-shaped mounting support of FIG. 5.

FIG. 6 shows a top view of the mounting support 30 shown in FIG. 5. Another vertical support 46 is shown attached to the right side portion 34.

It is important to note that only three mounting support configurations are shown by the drawings. However, numerous other configurations can be used to meet the needs of each special occasion.

While the invention has been particularly shown and described in reference to preferred embodiments thereof, it will be understood by those skilled in the art that changes in the form and details may be made therein without departing from the spirit and scope of the invention.

We claim:

1. Mounting means for mountable remembrance items to designate a special occasion comprising, in combination, a mounting support having means coupled to said mounting support for holding a plurality of said mountable remembrance items;

said mounting support including a board whose outside configuration can be varied to meet the needs of each special occasion; and said means coupled to said mounting support including a plurality of vertical slots passing through said board and a plurality of circular apertures passing through said board, each one of said circular apertures being located on top of a corresponding one of said vertical slots so that each of said mountable remembrance items can be removably mounted on said board by inserting each of said mountable remembrance items through one of said circular apertures and sliding each of said mountable remembrance items down said corresponding one of said vertical slots.

2. A combination of mounting means and mountable remembrance items to designate a special occasion, comprising, in combination, a mounting support having means coupled to said mounting support for holding a plurality of said mountable remembrance items, and at least one of said mountable remembrance items removably mounted to said mounting support;

said mounting support including a board whose outside configuration can be varied to meet the needs of each special occasion; and said means coupled to said mounting support including a plurality of vertical slots passing through said board and a plurality of circular apertures passing through said board, each of said circular apertures being located on top of a corresponding one of said vertical slots so that each of said mountable remembrance items can be removably mounted on said board by inserting each of said mountable remembrance items through one of said circular apertures and sliding each of said mountable remembrance items down said corresponding one of said vertical slots.

3. The combination of mounting means and mountable remembrance items of claim 2 wherein each of said mountable remembrance items comprises remembrance configuration member means for providing a designation of a desired event to be remembered, and coupling means attached to said remembrance configuration member means for permitting said remembrance configuration member means to be attached to said mounting support for holding a plurality of said remembrance configuration member means.

4. The mounting means of claim 1 wherein said board having a configuration that is symmetrical about a vertical axis through the center of the board.

5. The mounting means of claim 4 wherein said board is a flat board, said flat board having a substantially heart-shaped outside configuration.

6. The mounting means of claim 4 wherein said board is a flat board, said flat board having a substantially square-shaped outside configuration that has been rotated forty-five degrees to provide a top and bottom pointed portion.

7. The mounting means of claim 6 wherein said flat board having a decorative tassel attached thereto.

8. The mounting means of claim 4 wherein said board is a flat board said flat board having substantially a stylized butterfly outside configuration.

9. The mounting means of claim 8 wherein said flat board being divided substantially in half along a vertical axis through the center of the board providing two symmetrical halves, said flat board having hinges holding said symmetrical halves together.

10. The combination of mounting means and mountable remembrance items of claim 3 wherein said coupling means comprises a disk attached to the base of said remembrance configuration member means.

11. The combination of mounting means and mountable remembrance items of claim 10 wherein said disk being placed inside the bottom of said remembrance configuration member means.

12. The combination of mounting means and mountable remembrance items of claim 11 wherein said remembrance configuration member means comprises a flower-shaped configuration comprising a flexible net type fabric having a ribbon attached to the bottom portion of said remembrance configuration member means.

13. The combination of mounting means and mountable remembrance items of claim 12 wherein said remembrance configuration member means having its bottom portion below said ribbon filled with candy.

14. The combination of mounting means and mountable remembrance items of claim 13 wherein said coupling means comprises a disk placed inside the bottom portion of said remembrance configuration member means and below said ribbon, said candy being placed on top of said disk.

15. The combination of mounting means and mountable remembrance items of claim 3 wherein said board is a flat board, said flat board having a substantially heart-shaped outside configuration, said configuration being symmetrical about a vertical axis, said configuration member means comprises a flexible net type fabric having a ribbon tied to the bottom portion of said member means to provide a flower-shaped configuration, said configuration member means having its bottom portion below said ribbon filled with candy, said coupling means comprises a thin disk placed inside the bottom portion of said configuration member means and below said ribbon, said candy being placed on top of said disk, said disk having a diameter smaller than the diameter of said circular apertures and larger than the width of said vertical slots.

16. The combination of mounting means and mountable remembrance items of claim 3 wherein said board is a flat board, said flat board having a substantially square-shaped outside configuration that has been rotated forty-five degrees to provide a top and bottom pointed portion, said configuration being symmetrical about a vertical axis, said flat board having a decorative tassel attached thereto, said configuration member means comprises a flexible net type fabric having a ribbon tied to the bottom portion of said member means to provide a flower-shaped configuration, said configuration member means having its bottom portion below the ribbon filled with candy, said coupling means comprises a thin disk placed inside the bottom portion of said configuration member means and below said ribbon, said candy being placed on top of said disk, said disk having a diameter smaller than the diameter of said circular apertures and larger than the width of said vertical slots.

17. The combination of mounting means and mountable remembrance items of claim 3 wherein said board is a flat board, said flat board having a substantially stylized butterfly outside configuration, said configuration being symmetrical about a vertical axis, said flat board being divided substantially in half along a vertical axis through the center of the board providing two symmetrical halves, said flat board having hinges holding said symmetrical halves together, said configuration member means comprises a flexible net type fabric having a ribbon tied to the bottom portion of said member means to provide a flower-shaped configuration, said configuration member means having its bottom portion below said ribbon filled with candy, said coupling means comprises a thin disk placed inside the bottom portion of said configuration member means and below said ribbon, said candy being placed on top of said disk, said disk having a diameter smaller than the diameter of said circular apertures and larger than the width of said vertical slots.

* * * * *